US005588559A

United States Patent [19]

Vallet Mas et al.

[11] Patent Number: 5,588,559

[45] Date of Patent: Dec. 31, 1996

[54] USE OF POLYMERIC MEMBRANES IN THE DISPENSING OF PHARMACEUTICAL SOLUTIONS THAT CONTAIN QUATERNARY AMMONIUM COMPOUNDS AS PRESERVATIVES AND CORRESPONDING DOSE DISPENSER

[75] Inventors: Alberto Vallet Mas, Barcelona; Francesc X. Gimenez Guasch, Premia de Mar, both of Spain

[73] Assignee: Laboratorios Cusi, S.A., El Masnou, Spain

[21] Appl. No.: 265,409

[22] Filed: Jun. 24, 1994

[30] Foreign Application Priority Data

Jun. 25, 1993 [ES] Spain ..... 9301443
Jun. 9, 1994 [ES] Spain ..... 9401260

[51] Int. Cl.[6] ..... B65D 1/08

[52] U.S. Cl. ..... 222/92; 222/189.06; 222/190; 222/420; 604/295; 210/445; 210/455; 210/456

[58] Field of Search ..... 222/92, 107, 189.06, 222/189.08, 189.09, 190, 420; 604/295; 210/445, 455, 456

[56] References Cited

U.S. PATENT DOCUMENTS

| | | | |
|---|---|---|---|
| 4,229,306 | 10/1980 | Hein et al. | 210/455 X |
| 4,463,880 | 8/1984 | Kramer et al. . | |
| 4,485,014 | 11/1984 | Gilroy et al. | 210/445 X |
| 4,846,810 | 7/1989 | Gerber . | |
| 4,938,389 | 7/1990 | Rossi et al. | 222/189.08 |
| 5,056,689 | 10/1991 | Heyl et al. | 222/189.06 |
| 5,074,440 | 12/1991 | Clements et al. . | |
| 5,105,993 | 4/1992 | La Haye et al. | 222/189.09 |
| 5,219,101 | 6/1993 | Matkovich et al. | 222/189.06 |
| 5,249,712 | 10/1993 | Lontrade et al. | 222/189.08 |
| 5,265,770 | 11/1993 | Matkovich et al. | 222/420 X |
| 5,269,917 | 12/1993 | Stankowski | 210/455 X |
| 5,310,085 | 5/1994 | Lontrade et al. . | |
| 5,373,971 | 12/1994 | Laffy . | |

FOREIGN PATENT DOCUMENTS

| | | | |
|---|---|---|---|
| 439999 | 8/1991 | European Pat. Off. . | |
| 567431A1 | 10/1993 | European Pat. Off. | 604/295 |
| 2422569 | 11/1979 | France . | |
| 2661401 | 10/1991 | France . | |
| 2678905 | 1/1993 | France | 222/420 |
| 99011 | 3/1981 | Spain . | |
| 257316 | 4/1981 | Spain . | |
| WO90/05110 | 5/1990 | WIPO . | |
| WO91/16868 | 11/1991 | WIPO . | |
| WO9204004 | 3/1992 | WIPO . | |
| WO9209523 | 6/1992 | WIPO | 222/189.07 |
| WO93/10015 | 5/1993 | WIPO . | |

OTHER PUBLICATIONS

Polymer–Surfactant Interaction Part I.—Uncharged Water–Soluble Polymers and Charged Surfactants (Colloids and Surfaces 1986)—E. D. Goddard.

Containers, Preservatives and Contact Lens Solutions (Science & Technology)—N. E. Richardson et al., BPharm, PhD. Nov. 1979.

Interactions of Polymers and Cationic Surfactants With Thiocyanate as Counterions a (Journal of Colloid and Interface Science, vol. 30, No. 2, Jun. 1969)—Shuji Saito et al.

Adsorption of Benzalkonium Chloiride onto Different Filter Media During Bacteriological Filtration (Pharm. WeekBlad 1971)—N. T. Naidoo et al.

*Primary Examiner*—Andres Kashnikow
*Assistant Examiner*—Kenneth Bomberg
*Attorney, Agent, or Firm*—Darby & Darby

[57] ABSTRACT

A dispenser for pharmaceutical solutions which includes membranes which are placed in a dropper of the dispenser and are used to achieve the flow of essentially all the active product and the retention of essentially all the preservative during pharmacological treatment. The membrane is coupled between two cylinder units on parts of the dropper, which remain in a relatively movable position, owing to the existence of a certain play between the cylinder units; or the cylinder units may be in a relatively fixed position, owing to the lack of such play. The cylinder unit may also be in a fixed position but with a membrane treated adequately so as to have a small area or "stain" that permits the flow of air.

12 Claims, 6 Drawing Sheets

USE OF POLYMERIC MEMBRANES IN THE DISPENSING OF PHARMACEUTICAL SOLUTIONS THAT CONTAIN QUATERNARY AMMONIUM COMPOUNDS AS PRESERVATIVES AND CORRESPONDING DOSE DISPENSER

TECHNICAL FIELD OF THE INVENTION

The present invention refers to a new container to dose pharmaceutical solutions that include a quaternary ammonium compound as a preservative.

In particular the invention refers to a new container that includes one or several membranes of polymeric material, preferably polyvinylidene fluoride (PVDF) or polysulfone, capable of selectively retaining, when applied the quaternary ammonium compounds, preferably benzalkonium chloride (BAC), or benzethonium chloride (BTC), that pharmaceutical solutions include as a preservative permitting the free flow without retention of the active principles.

PRIOR ART OF THE INVENTION

The need to include in pharmaceutical solutions, particularly ophthalmic solutions, that are to be applied in successive doses elements that are capable of preventing or limiting therein the growth of microorganisms that can contaminate the patient when he uses them, preventing greater harm than that whose alleviation is sought, is known. All the excipients of the formulation that are used for this cited purpose are called preservative systems. A group of substances that are used as a preservative system due to their broad antimicrobial spectrum are quaternary ammonium compounds.

From a chemical point of view, the quaternary, ammonium compounds used are products resulting from the reaction of an organic halide, preferably a chloride or a bromide, with a tertiary amine. The chemical structure that they have is the following:

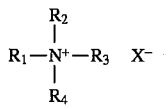

wherein $R_1$, $R_2$, $R_3$ and $R_4$ are:

alkyl, alkylene, alkyl or aryl groups;

identical or different;

substituted or unsubstituted;

branched or unbranched;

cyclic or linear;

that main contain ether, ester or amide bonds;

and X is the corresponding halide.

Within the compounds belonging to this group that are included in pharmaceutical formulations as the preservative system, benzalkonium chloride, benzethonium chloride, benzodecinium bromide, cetalkonium chloride, cetexonium bromide, cetrimide and cetylpyridine, among others, stand out.

The concentrations of quaternary ammonium compound that are normally used in pharmaceutical solutions vary between 0.0005% and 1.0%, depending on the rest of the components of the formulation.

Said quaternary ammonium compounds, have the characteristic, just like other cationic surface active agents, of interacting with different polymeric materials (Salto and Yukawa (1969), Naldo et al. (1971) , Richardson et al.

(1979); Goddard (1986.) Said interaction causes difficulties in the handling and storage of preparations that contain quaternary ammonium compounds and that have to come in contact with polymeric materials.

On the other hand, the concentrations of quaternary ammonium compounds that are needed to be reached to ensure the antimicrobial effect can, in some cases, give rise to undesirable side effects. Among others, corneal de-epithelization, modification of the scarring of the cornea, modification of the electrophysiology of the corneal membrane and of the oxygenation of the cornea can be pointed out. Said effects can be increased depending on the pathological state of the cornea and can have a greater repercusion on the patient who has to be subjected to chronic treatment, such as antiglaucomatous treatments. Said side effects can affect the bioavailability of the active principle that the pharmaceutical solution Includes.

Different researchers have tried to minimize the cited effects from the point of view of the container. The main solutions proposed are the following ones:

1. The system described in Spanish industrial model no. 99011 "Group of containers of a dosed content" and in Spanish utility model 257316 "Group of containers-eye droppers of a dosed content" consists of a container that contains the necessary amount of the solution, preservative-free, for a single application discarding the same after use thereof. This system has the inconvenience that it has to be made in perfectly sterile conditions, since if there is any contamination at the moment of initial packaging, or subsequently inside the monounits and as there is no preservative, said contamination cannot be counteracted. Another limitation is the need to make the user aware that once a unit has been used, it should be discarded, though there is a residual volume left. As an economic restriction the high price of each unit with regard to the conventional multidose system stands out.

2. Systems described in U.S. Pat. No. 0,401,022 Matrovich "Contamination-Resistant Dispensing and Metering Device" and U.S. Pat. No. 4,463,880 Kramer et al. "Medicine Drop Dispenser with Anti-Bacterial Filter" that consist preventing contamination entering the inside of a container, that contains a preservative-free solution, by means of use of reduced pore size filters. This system has the advantage of ensuring sterility of the liquid instilled even when the latter is contaminated, due to the solution being filtered again before coming out of the container. The inconveniences of this option are in the first place the poor appearance that a contaminated solution may have and the relatively high force that the filter offers due to the small size of the potr. Besides, the filters do not allow air to enter, which implies a gradual contraction of the container, as the amount of product applied increases. These inconveniences make industrialization and marketing of this system difficult.

3. French patent FR 2661401 Chibret et al. "Procédé conditionnement pour sonservar et distribuer para portions du liquide sterile", consists of placing in the end of the container a column that selectively retains the preservative and not the active principle. As a main inconvenience the need to design a column for each family of active principles and preservatives, which results very complicated and burdensome is worth pointing out. Consequently, the price of each unit turns out to be very high. Besides, the container must be able to contract, for the above cited reasons.

4. In U.S. patents: U.S. Pat. No. 4,846,810 Gerber et al. "Valve Assembly," U.S. Pat. No. 5,074,440 Clements et al. "Container for dispensing Preservative-Free Preparations and U.S. Pat. No. 563,504 "Laffy "Aseptic Bottle," different mechanisms of the valve or seal type, that try to dose a preservative-free solution, not permitting outside contamination to enter, can be observed. An inconvenience that they have is the incapacity to eliminate contamination present in the liquid that they contain. Another disadvantage of these alternatives is the high cost of each unit, the difficult industrialization thereof, as well as the significant task of informing the user who requires them. This container must also prevent the contraction thereof, due to the principal of its operation.

The cited solutions do not satisfactorily solve the posed problem, thus, it is still necessary to find a system that permits quaternary ammonium compounds to be present in the formulation of the pharmaceutical solution, to ensure that pathogenic microorganisms cannot grow therein during the time of storage and use, and on the other hand, that the concentration of the preservative that reaches the patient in applying the solution is low enough so as to eliminate, or minimize the above mentioned side effects.

DESCRIPTION OF THE INVENTION

The present invention proposes to achieve the above cited aim by means of the container described in the same. Said container includes membranes that are capable of retaining the quaternary ammonium compounds at the moment of application. The device described in the present invention is to be coupled to the container that contains the pharmaceutical solution with quaternary ammonium compounds. In this way the preservative system can carry out its function during the time of storage and use of the same, whereby it is ensured that no microorganisms will grow in the solution, but it will be retained totally, or partially, upon passing through the membrane, or membranes, of the container at the moment of application reaching the surface to be treated a concentration of quaternary ammonium compound low enough so as to minimize the undesirable side effects of the cited compounds.

In particular, the materials that the container can include are commercial membranes of cellulose triacetate, cellulose nitrate, regenerated cellulose, nylon PVDF silicones, polysulfone, polycarbonate, among others. The thickness of the membranes, the number, the pore size of the same and in short the area of filtration of the same will depend on the nature of the formulation to be used and the percentage of retention of quaternary ammonium compounds that is desired to be given to the container.

To ensure the optimum use of the container, the membrane, or membranes, will have to be located in the outlet end, or dropper, of the dose dispensor. The present invention proposes two forms and one variant to place the membrane or membranes, in the dropper of the dose dispensor.

The first one of said ways, which we will call "movable filter", is based on the membrane having a possibility of movement as a result of the existence of a certain play between the cylinder units (FIG. 3) in such a way that when the liquid returns to the preservation area of the dropper a vacuum is produced (since one part of the liquid has been supplied outside) and, consequently the membrane moves downward permitting air to flow inside the preservation area thus preventing the container from wrinkling and that, as the following successive doses are administered, it be necessary to press harder each time the dose dispensor to achieve the application of the corresponding dose of the pharmaceutical solution.

The second way to place the membrane in the dropper of the dose dispensor is what we will call a "fixed filter." In it, the membrane, or membranes, remain fixed without any possibility of movement between the cylinder units (FIG. 4.) In this case, upon applying the pharmaceutical solution, the container is susceptible to shrink depending on the proportion of volume applied with regard to the useful volume of the container without the preserving effectiveness of the pharmaceutical solution inside the container being affected.

A variant of this latter "fixed filter", which would permit air to enter (just like in the first form), would be to treat the membrane adequately, so that it has a "stain", or small area, that permits the flow of air.

The proposed ways ensure that the pharmaceutical solution that has not been applied, but which goes beyond the membrane, goes back inside the container. In the event that this return does not take place and it remains retained in the outside of the dropper, it would be susceptible to contamination without the preservative system being able to act.

It has been verified that the percentage of retention of the preservative, is somewhat lower than what is desired, it being possible to improve the same upon reducing the concentration of the quaternary ammonium compound and simultaneously increasing the diameter of the membrane or membranes in order to optimize the dispersion of the flow through the same.

This has been achieved by changing the structure of the dropper in its connection to the neck of the container of the product, upon the bottom body of said dropper remaining fastened to the container by the outside of the neck and in such a way that the membrane or membranes that define the filtering unit can have a larger diameter even that of the mouth itself of the container. Besides, the distribution of the cylinders or support projections of the filtering membrane or membranes is improved, so that the product extends easily over the entire surface of the membrane and thus passes through it more easily, avoiding in turn the possibility that the same be perforated if a strong pressure of supply is exerted, or unless it deteriorates prematurely.

Whether the membranes belong to a "movable filter" or to a "fixed filter", the support projections for the membrane are materialized by small finger-type cylinders, distributed preferably in concentric annular alignments. The small cylinders that surround the axial opening for flow of the product from the main body to the container have their free edges joined by means of a disk-shaped partition, of the same or different material, defining a small radial diffusion chamber given that the flow of the product in an axial direction is prevented, thus this small disk acts as a deflecting element. In the top part of the dropper, or top body of the same, there are also these support fingers of the membrane, with an identical distribution and the innermost ones having their ends likewise joined by another small disk, of an identical function and which on the other hand does not interfere with the outflow of the pharmaceutical solution.

All this plurality of support projections for seating the filtering membranes can also be achieved upon providing a plurality of concentric annular partitions equidistant to each other, there being some radial or diametric cuts that form in the same passage or intercommunication ducts between the chambers formed between said annular partitions, thus obtaining a good dispersion of flow through the entire surface of the membrane. There may also be other radial channels that start in the outside part and that do not reach the center, precisely to shorten the length of the partitions radially farthest away from the center, if necessary. The innermost annular partition also having the above mentioned radial cuts is closed by another small wall or cover to prevent the direct passing of the flow preventing the membrane from wearing or breaking, as we had indicated above.

The bottom body of the dropper is the element which includes the inside thread for connection to the neck of the container, having on its bottom end the sealing ring. It is also provided for that it is not necessary to include the cited thread and that this bottom body of the dropper were to fit by pressure on the neck of the container, though the corresponding sealing ring were included. The outlet mouth of the curative product, formed in the top part of the dropper, advantageously includes an outside thread for anchoring a small sealing cover of said mouth, likewise provided with a sealing ring that remains locked in the corresponding toothing provided for opposite the dropper.

In order to provide a better understanding of the features of the invention and forming an integral part of this specification, some sheets in whose figures, the following has been represented in an illustrative and non-restrictive manner are attached hereto.

DESCRIPTION OF THE PREFERRED EMBODIMENTS OF THE INVENTION

Figure 1:
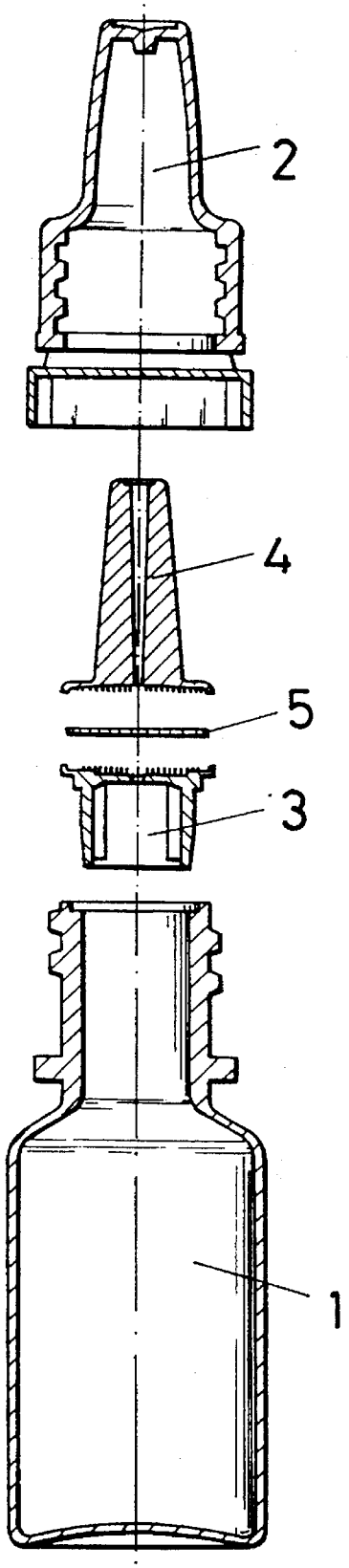
FIG. 1 represents an exploded and section view of a dose dispensor that includes the filtering membrane or membranes used in the present invention.
Figure 2:
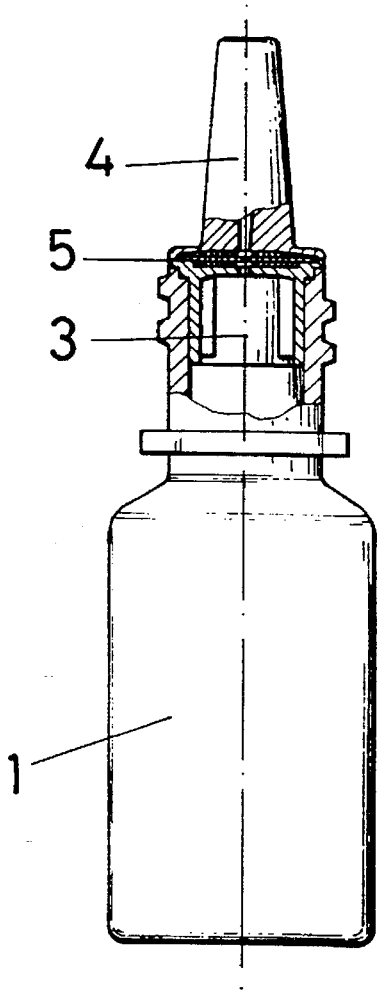
FIG. 2 represents the position of assemblying the dose dispensor of FIG. 1, without including the thread cap.

In FIGS. 1 and 2 one can see a dose dispensor included in the present invention. As can be seen, said container has a container (1) of a material easily deformable by pressure, a thread cap (2) with its corresponding sealing ring, a dropper divided in two parts, a bottom one (3) and another top one (4) and, finally the membrane or membranes (5) that are located between the cited two parts (3) and (4) of the dropper.

Hereinafter two embodiments and a variant described in the invention are described in terms of the arrangement of the membrane, membranes, in the dropper of the dose dispensor:

"Movable filter" embodiment

Figure 3:
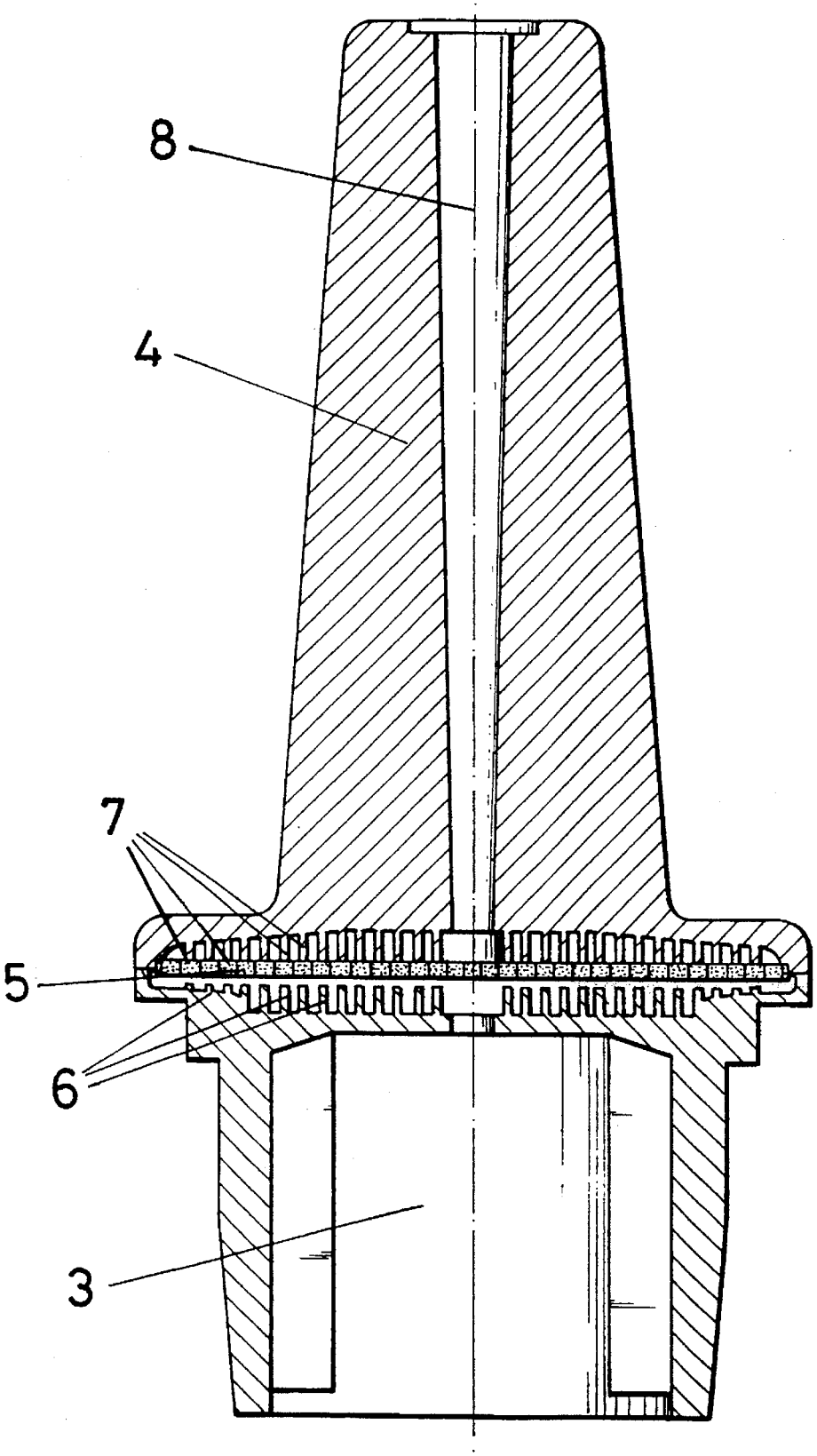
FIG. 3 represents a larger scale sectioned view of the dropper in the "movable filter" embodiment.

In view of the commented FIG. 3, one can see how the membrane (5) is located between the cylinder units (6) and (7) of the bottom (3) and top (4) parts of the dropper respectively. Between both cylinder units there is a certain separation or play, whereby the membrane can move in the corresponding free space. In this way, when pressure is exerted on the container (1) of FIGS. 1 and 2, the pharmaceutical solution contained in the same rises through the inside cylindric part of piece (3) of the dropper, until the center hole is reached; at this point, the pressure of the liquid makes the membrane rise until it comes in contact with the top cylinder unit, filling the entire space that remains free and spreading around the entire surface of the membrane. The liquid that passes through the membrane substantially preservative-free, rises through the inside center reverse truncated-cone shaped cavity (8) of the top part (4) of the dropper until the outside. Upon the pressure exerted on the container (1) ceasing, the air itself that enters through the center hole (8) of the top part (4) to counteract the vacuum produced by the liquid removed, pushes the membrane downward which remains supported on the bottom cylinder unit of part (3) of the dropper, leaving a cavity through which the liquid retained in the duct (8) spreads again through the membrane and between the spaces existing between the cylinders (6), going back inside the container for its preservation. In this way, the container recovers its initial shape and no liquid remains in the top part of the dropper which could be easily contaminated upon being substantially preservative-free.

The operation described is repeated as many times as necessary during the patient's treatment with a total guarantee of preservation and easy application.

"Fixed filter" embodiment

Figure 4:
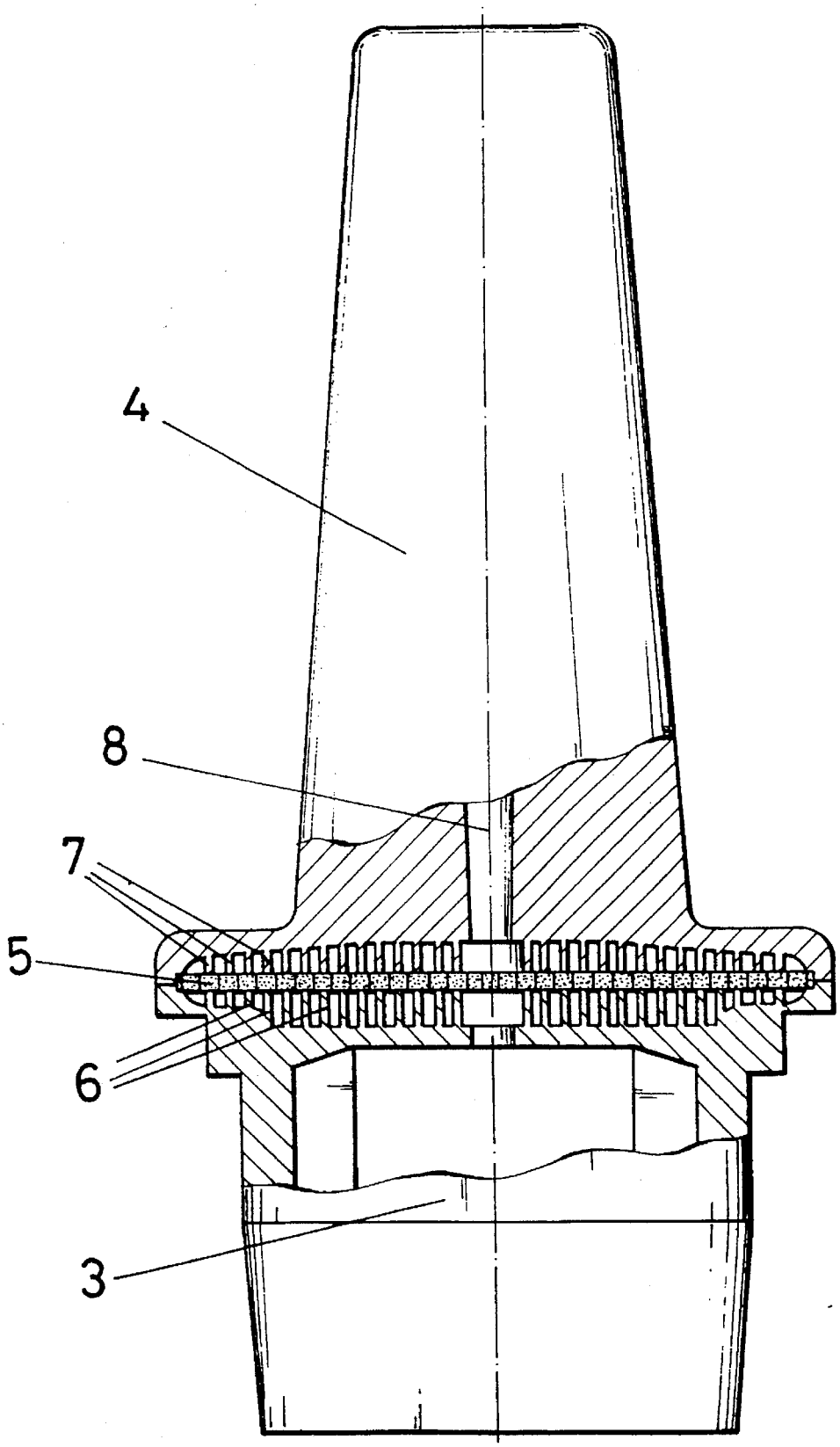
FIG. 4 represents a larger scale sectioned view of the dropper in the "fixed filter" embodiment.

In view of FIG. 4 one can see how the membrane (5) is located between the cylinder units (6) and (7) of the bottom (3) and top (4) parts of the dropper respectively. Between both cylinder units there is a separation just to couple the membrane, which remains fixed between both without the possibility of any type of movement or displacement. In this way when pressure is exerted on the container (1) of FIGS. 1 and 2, the pharmaceutical solution contained in the same rises through the cylindric inside part of piece (3) of the dropper until the center hole is reached where the liquid spreads through the cavities existing in the cylinder unit (6) to pass through the membrane on its entire surface, spreading the liquid already preservative-free through the cylinder unit (7) and rising through the inside center reverse truncated-cone shaped cavity (8) of the top part (4) of the dropper to the outside.

With this embodiment, the container (1) is susceptible to contract but there is no danger of contamination of the solution.

"Fixed filter with stain" embodiment

The assembly and embodiment of this variant is identical to the previous one "fixed filter", only that there is a special treatment of a small part of the membrane or "stain" which permits air to flow through, thus avoiding the possible contraction of the container.

Making special reference to FIGS. 5 to 8, we can see show the dose dispensor of pharmaceutical solutions that the invention proposes, includes the improvements referred to regarding the structure of the container.

Now then, the new dose dispensor that is proposed includes a dropper generally referred to as number (9), whose bottom body (10) includes an annular flap (11) that immobilizes the neck (12) of the container (1), including the sealing ring (13) that immobilizes the sawtoothing (14) of the neck of the container (1.) As we have said above, it is even possible to omit the thread since the bottom body can remain directly anchored by pressure and insertion.

The top body of the dropper (9) is referred to as number (15) and its dose mouth remains closed with the sealing cap (16) upon including a thread (17.)

Between bodies (10) and (15) of the dropper there is the membrane (18) whose diameter is notably larger than that which the membrane (5) may have in the structure of the dropper to which we have reffered in FIGS. 1 to 4.

Figure 8:
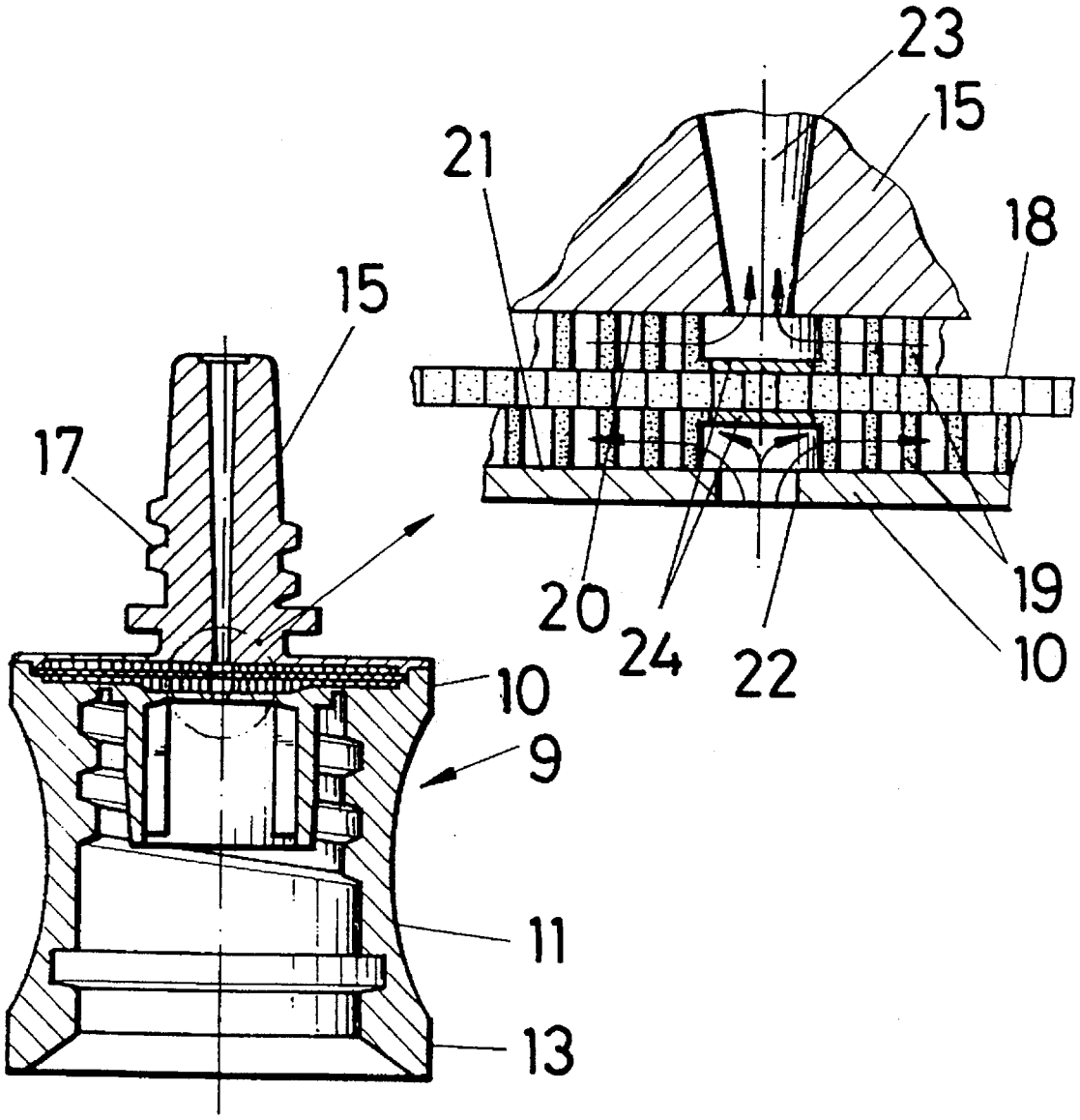
FIG. 8 is a view identical to FIG. 4, assembled and with an enlarged detail to show the axial structure of the support projections of the membrane, preventing the direct flow of the product outwards.

In the enlarged detail of FIG. 8 we can also see how the membrane (18) remains fastened in this preferred embodiment, between the projections (19) of axial direction, emerging from respective recessed surfaces (20) and (21) of the proximate bases of both top (15) and bottom (10) bodies of the dropper (9), respectively. Such projections are formed as concentric annular partitions that have a discontinuous arrangement in each annular alignment, upon there being radial or diametric cuts or channels to permit easy distribution of the product towards the entire surface of the filtering membrane (18) from the axial access hole (22), just as the arrows of this FIG. 8 indicate.

In order to prevent if too much pressure is exerted on the container (1) the product from going a totally axial direction upon the hole (22) of the bottom body (10) of the dropper being aligned with the conical outlet hole (23) of the product towards the outside, just as we had indicated before, it has been provided for that, in this embodiment shown in the figures, this direct path that could end up damaging the membrane (18) and even breaking it, is intercepted upon providing in this passage area some small horizontal partitions (24), as circular covers of the same material as the respective body of the dropper, establishing contact in this embodiment, with the membrane or membranes (18). These disks (24) close the discontinuous periphery of the free edges of the projections (19) located in the innermost annular partition.

Figure 5:
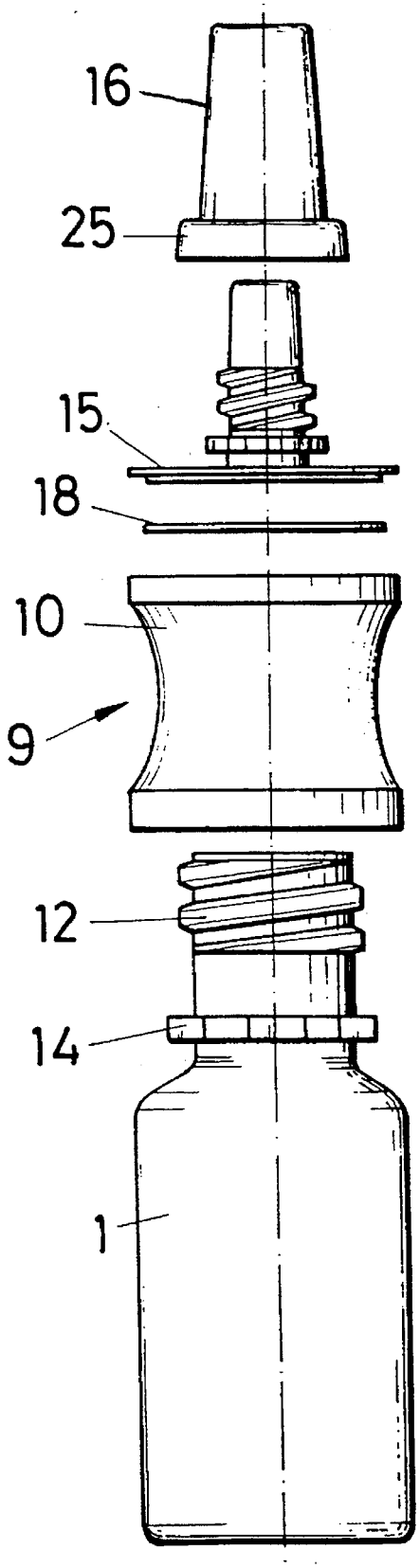
FIG. 5 is an exploded view of the dose dispensor of pharmaceutical solutions, including the improvements object of the present invention.
Figure 6:
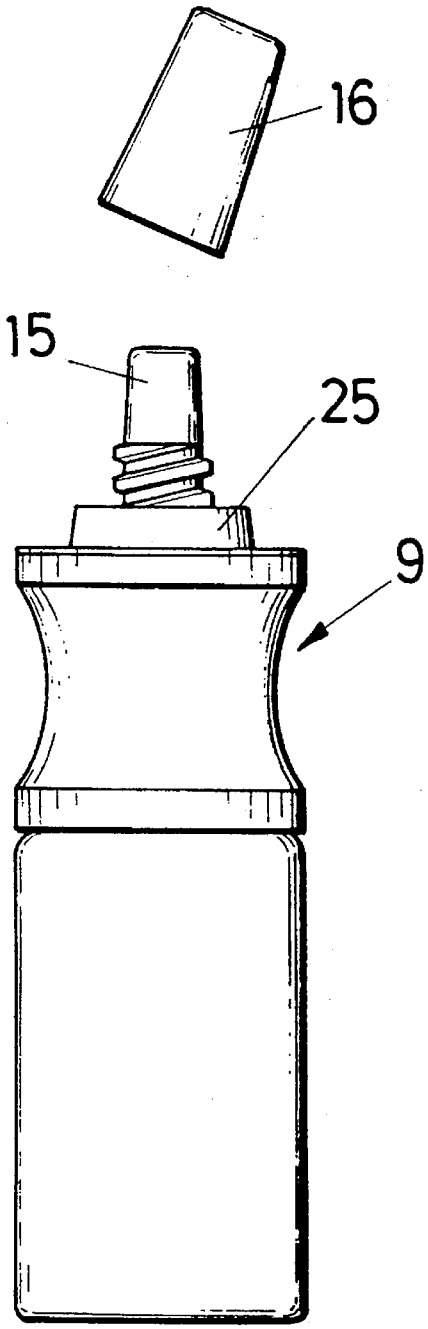
FIG. 6 is a view of the same container of FIG. 2, totally assembled and with the cover of the supply mouth without the seal.
Figure 7:
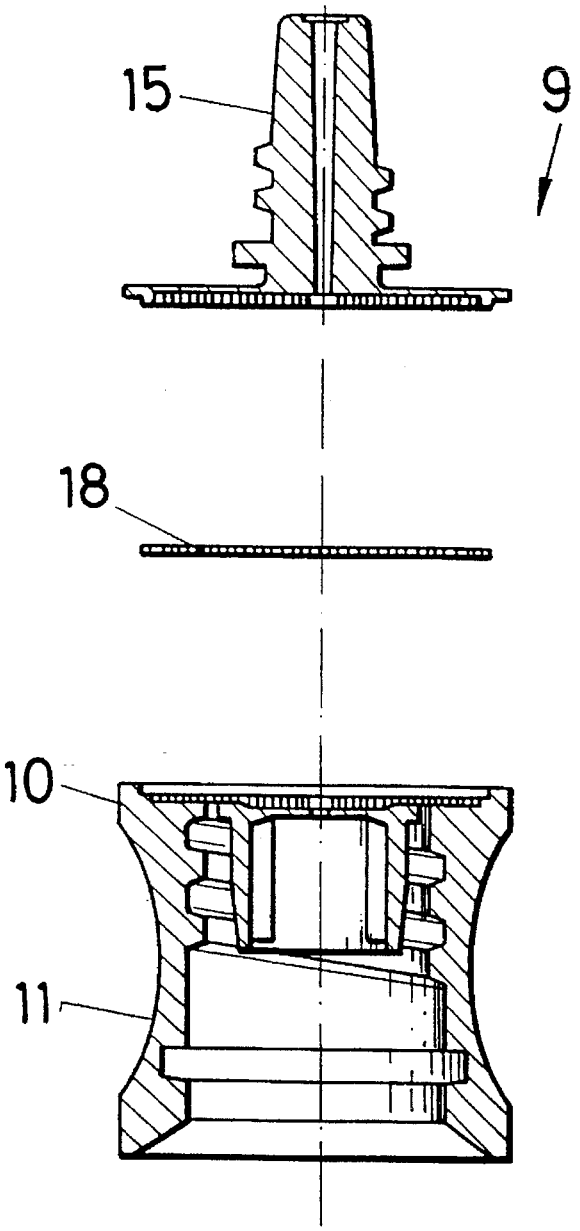
FIG. 7 is an exploded view of the dropper wherein the two component bodies thereof and an intermediate filtering membrane are observed on a larger scale.

In FIGS. 5 and 6 we see the sealing cap (16) also provided with a sealing ring (25.)

EXAMPLES OF USE

The present invention is additionally illustrated by means of the following representative Examples, which must not be considered as a limitation of the scope of the same, made with a dose dispensor of the type shown in FIGS. 1 to 4:

Example 1: A study of the retention of preservative of a solution that contained 0.5% thymolol maleate and 0.1% benzalkonium chloride. A commercial membrane of PVDF of 0.45 μm and 13 mmϕ had been included in the container. The percentage of benzalkonium chloride retained at the end of application of 5 ml. of the cited solution was 76%, without observing any retention of the active principle.

Example 2: A study was conducted on the retention of preservative of a solution that contained 2% carteolol hydrochloride and 0.005% benzalkonium chloride. A commercial membrane od PVDF of 0.22 μm and 13 mmϕ had been included in the container. The percentage of benzalkonium chloride retained at the end of the application of 5 ml. of the cited solution was 100%, without observing any retention of the active principle.

Example 3: A study was conducted on the retention of preservative of a solution that contained 20% pilocarpine chloride and 0.01% benzalkonium chloride. A commercial membrane of PVDF of 0.45 μm and 13 mmϕ had been included in the container. The percentage of benzalkonium chloride retained at the end of the application of 5 ml. of the cited solution was 76%, without observing any retention of the active principle.

Example 4: A study was conducted on the retention of preservative of a solution that contained 0.5% thymolol maleate and 0.01% benzalkonium chloride. A commercial membrane of PVDF of 0.2 μm and 13 mmϕ had been included in the container. The percentage of benzalkonium chloride retained at the end of the application of 5 ml. of the cited solution was 90%, without observing any retention of the active principle.

Example 5: A study was conducted on the retention of preservative of a solution that contained 4% sodium chromoglycate and 0.1% benzalkonium chloride. A commercial membrane of PVDF of 0.45 μm and 13 mmϕ had been included in the container. The percentage of benzalkonium chloride retained at the end of the application of 5 ml. of the cited solution was 45%, without observing any retention of the active principle.

Example 6: A study was conducted on the retention of preservative of a solution that contained 4% sodium chromoglycate and 0.01% benzalkonium chloride. A commercial membrane of PVDF of 0.22 μm and 13 mmϕ had been included in the container. The percentage of benzalkonium chloride retained at the end of the application of 5 ml of the cited solution was 48%, without observing any retention of the active principle.

We claim:

1. A dispenser for dosing a pharmaceutical solution including active ingredients and a preservative containing a quaternary ammonium compound, said dispenser comprising a container and a cap having a sealing ring and a dropper;

said dropper being divided into a lower portion and an upper portion at least one polymer membrane being located between said portions, said membrane allowing selective passage of essentially the whole of the active ingredients in said pharmaceutical solution and selective retention of essentially the whole of the preservative;

said lower portion having a first group of passages therethrough in an area adjacent to said polymer membrane, said lower portion being capable of contacting said polymer membrane; and said upper portion having a second group of passages therethrough in an area adjacent to said polymer membrane, said upper portion being capable of contacting said polymer membrane.

2. A dose dispenser for pharmaceutical solutions, comprising:

a) an easily deformable container;

b) a dropper having a bottom part and a top part said bottom part being received in the container, the top part having a first cylinder unit and the bottom part having a second cylinder unit aligned with the first cylinder unit, said first and second cylinder units containing duct forming projections;

c) at least one polymeric membrane located within the first cylinder unit and the second cylinder unit and between the top part and the bottom part; and d) a cap constructed to be received on the container over the dropper and including means for securing the cap to the container.

3. The dose dispenser of claim 2, wherein the first cylinder unit and the second cylinder unit are sized so as to prevent movement of the membrane.

4. The dose dispenser of claim 2, wherein the projections are arranged in concentric annular alignment.

5. The dose dispenser of claim 2, wherein the membrane comprises cellulosctriacetate.

6. The dose dispenser of claim 2, wherein the membrane comprises cellulose nitrate.

7. The dose dispenser of claim 2 wherein the membrane comprises regenerated cellulose.

8. The dose dispenser of claim 2, wherein the membrane comprises nylon.

9. The dose dispenser of claim 2, wherein the membrane comprises silicone.

10. The dose dispenser of claim 2, wherein the membrane comprises oplyvinylidene fluoride.

11. The dose dispenser of claim 2, wherein the membrane comprises polysulfone.

12. The dose dispenser of claim 2, wherein the membrane comprises polycarbonate.

* * * * *